US008746927B1

(12) United States Patent
Nepple et al.

(10) Patent No.: US 8,746,927 B1
(45) Date of Patent: Jun. 10, 2014

(54) SYSTEMS, METHODS, AND DEVICES FOR PROVIDING FLEXIBLE HEAT SINKS TO LIGHT MODULES

(75) Inventors: Jeffrey Brian Nepple, Evergreen, CO (US); Adrian Thomas Ehresman, Aurora, CO (US); Peter J. Menard, Arvada, CO (US)

(73) Assignee: Cooper Technologies Company, Houston, TX (US)

( * ) Notice: Subject to any disclaimer, the term of this patent is extended or adjusted under 35 U.S.C. 154(b) by 55 days.

(21) Appl. No.: 13/103,519

(22) Filed: May 9, 2011

Related U.S. Application Data

(60) Provisional application No. 61/332,729, filed on May 7, 2010.

(51) Int. Cl.
*F21V 29/00* (2006.01)

(52) U.S. Cl.
USPC ..... 362/249.03; 362/147; 362/294

(58) Field of Classification Search
USPC ..... 362/249.03
See application file for complete search history.

(56) References Cited

U.S. PATENT DOCUMENTS

| | | | | |
|---|---|---|---|---|
| 7,722,227 | B2 * | 5/2010 | Zhang et al. | 362/364 |
| 8,047,694 | B2 * | 11/2011 | Lee et al. | 362/547 |
| 2005/0146899 | A1 * | 7/2005 | Joseph et al. | 362/408 |
| 2008/0247177 | A1 * | 10/2008 | Tanaka et al. | 362/373 |
| 2009/0231851 | A1 * | 9/2009 | Lai | 362/253 |
| 2010/0259919 | A1 * | 10/2010 | Khazi et al. | 362/296.01 |
| 2011/0048768 | A1 * | 3/2011 | Catchpole et al. | 174/120 R |
| 2011/0110108 | A1 * | 5/2011 | Calon et al. | 362/373 |
| 2011/0227507 | A1 * | 9/2011 | Salm | 315/312 |

* cited by examiner

*Primary Examiner* — Y My Quach Lee
(74) *Attorney, Agent, or Firm* — King & Spalding LLP

(57) ABSTRACT

An LED-based light fixture that includes a light fixture housing forming a light emission aperture, one or more LEDs attached to a circuit board that is surrounded by the light fixture housing and emits light through the light emission aperture when powered. The LED-based light fixture further includes at least one flexible heat sink member that is thermally coupled with at least a portion of the circuit board and the light fixture housing.

16 Claims, 4 Drawing Sheets

SYSTEMS, METHODS, AND DEVICES FOR PROVIDING FLEXIBLE HEAT SINKS TO LIGHT MODULES

RELATED APPLICATION

This application claims priority under 35 U.S.C. §119 to U.S. Provisional Patent Application No. 61/332,729, titled "Systems, Methods, and Devices for Providing Flexible Heat Sinks to Light Modules," filed on May 7, 2010, the entire contents of which are hereby fully incorporated herein by reference.

TECHNICAL FIELD

Embodiments of the invention relate generally to lighting solutions, and more particularly to systems, methods, and devices for providing flexible heat sinks to light modules.

BACKGROUND

Many general illumination light fixtures have incorporated light emitting diode (LED) light sources to produce light. Typically, light fixtures incorporating LEDs use heat sinks that are static and rigid to control the heat resulting from the use of LED light sources. The heat sink components often limit the design and configuration of the fixture itself, particularly with recessed and/or partially or fully enclosed light fixtures using LED light sources. Moreover, to accommodate the thermal tolerances of the fixture while rotating and/or aiming the LED light sources, directional LED based light fixtures often lower the power level supplied to the LED light sources to maintain proper thermal operating levels thereby decrease the efficiency advantages offered by using LED light sources versus conventional light sources (e.g., incandescent, fluorescent, etc.).

What is needed is a way to provide sufficient thermal control that allows for further design flexibility and/or greater efficiency (i.e., power efficiency, longer life of light source, etc.) when using LED light sources in light fixtures.

SUMMARY

According to an embodiment of the invention, there is disclosed a light fixture that includes an LED light module, where the LED light module is adjustable on at least one axis, and at least one flexible heat sink member is thermally coupled with at least a portion of the LED light module. In accordance with one aspect of the invention, the flexible heat sink member is braided. According to another aspect of the invention, the flexible heat sink member is tin plated copper.

In accordance with yet another aspect of the invention, the light fixture is recessed, and the flexible heat sink member terminates proximal to an opening of a light fixture housing, where the opening allows light emitted by the light module to exit the light fixture housing. According to another aspect of the invention, the light fixture is recessed, and the at least one flexible heat sink member terminates proximal to a trim of the light fixture housing. In accordance with yet another aspect of the invention, where the flexible heat sink member is thermally coupled with at least two portions of the LED light module.

According to another aspect of the invention, the LED light module is rotatable on at least one axis. In accordance with yet another aspect of the invention, the flexible heat sink member is configured in a light fixture housing so as to not interfere with the rotation of the LED light module. According to another aspect of the invention, the flexible heat sink member is thermally coupled with a circuit board of the LED light module, where the circuit board contains at least one LED. In accordance with yet another aspect of the invention, the flexible heat sink member is thermally coupled to a light fixture housing.

In accordance with another embodiment of the invention, there is disclosed an apparatus including a light fixture housing forming a light emission aperture, one or more LEDs attached to a circuit board that is surrounded by the light fixture housing and emits light through the light emission aperture when powered. The apparatus further includes at least one flexible heat sink member that is thermally coupled with at least a portion of the circuit board and the light fixture housing. According to another aspect of the invention, the flexible heat sink member is thermally coupled to the light fixture housing at a location proximal to the light emission aperture. In accordance with yet another aspect of the invention, the flexible heat sink is malleable.

According to another aspect of the invention, the flexible heat sink member is thermally coupled with at least two portions of the circuit board. In accordance with yet another aspect of the invention, the LEDs and circuit board are part of an LED light module, where the LED light module is rotatable on at least one axis. According to another aspect of the invention, the flexible heat sink member is configured in the light fixture housing so as to not interfere with the rotation of the LED light module. In accordance with yet another aspect of the invention, the flexible heat sink member is braided. According to another aspect of the invention, the flexible heat sink member is tin plated copper.

BRIEF DESCRIPTION OF THE FIGURES

Figure 1:
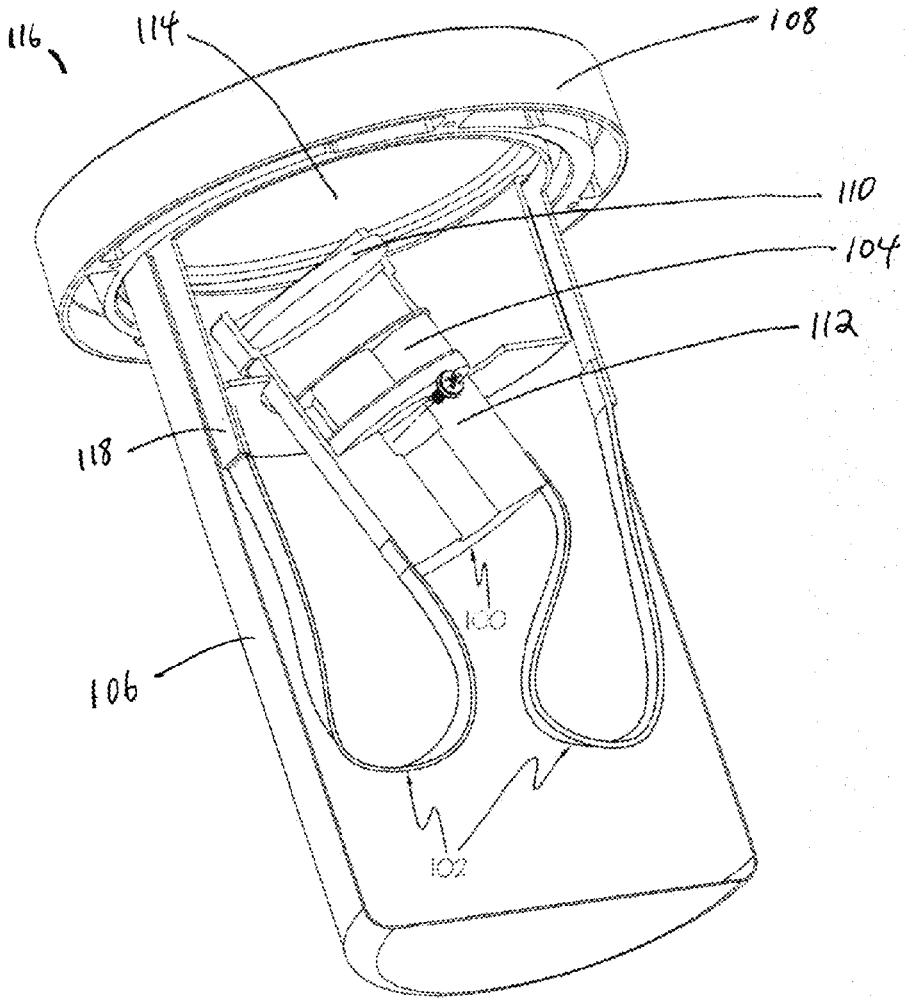

Having thus described the invention in general terms, reference will now be made to the accompanying drawings, which are not necessarily drawn to scale, and wherein:

FIG. 1 illustrates a cross sectional view of a light fixture having two flexible heat sink elements in accordance with one embodiment of the invention.

Figure 2:
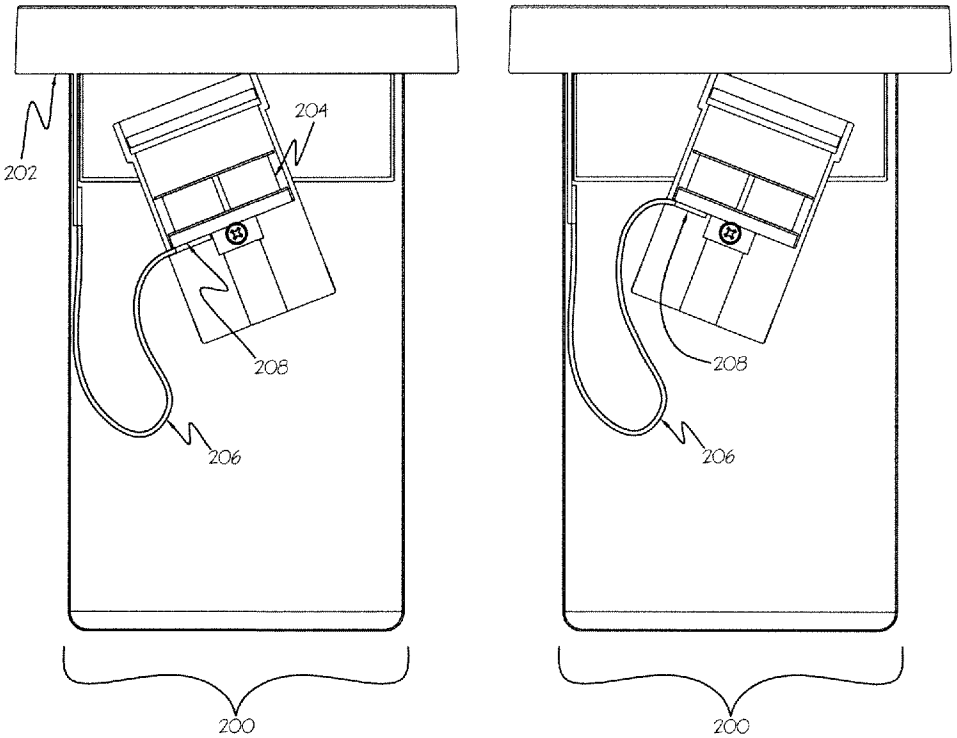

FIG. 2 illustrates another cross sectional view of a light fixture having a flexible heat sink in accordance with one embodiment of the invention.

Figure 3:
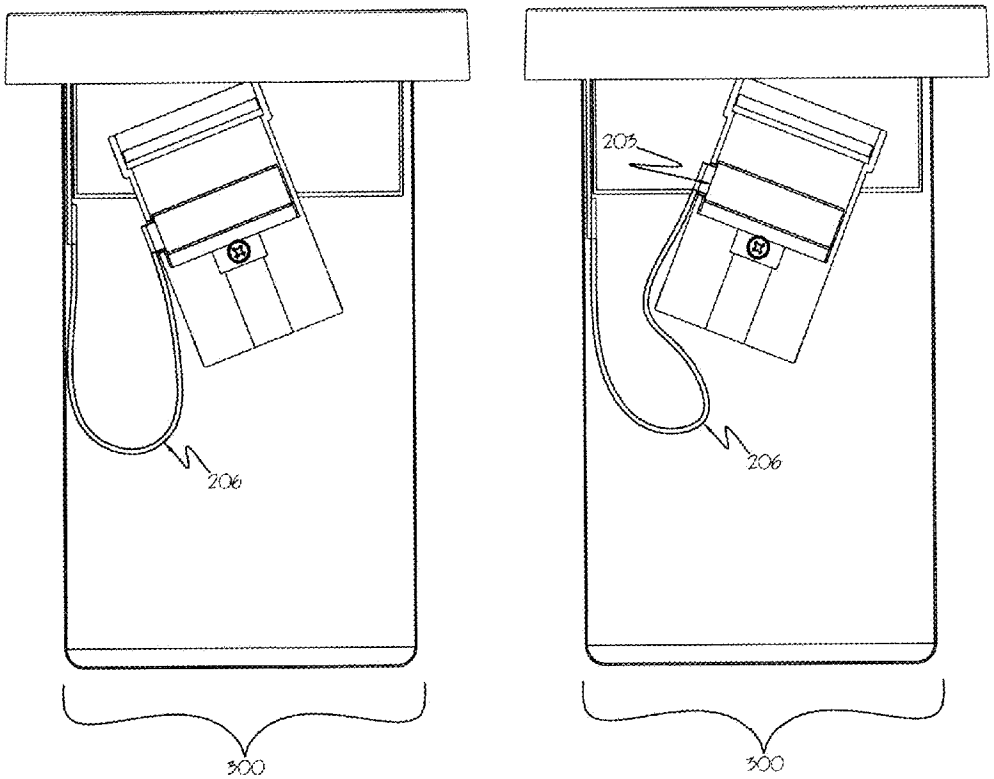

FIG. 3 illustrates yet another a cross sectional view of a light fixture having a flexible heat sink in accordance with another embodiment of the invention.

Figure 4:
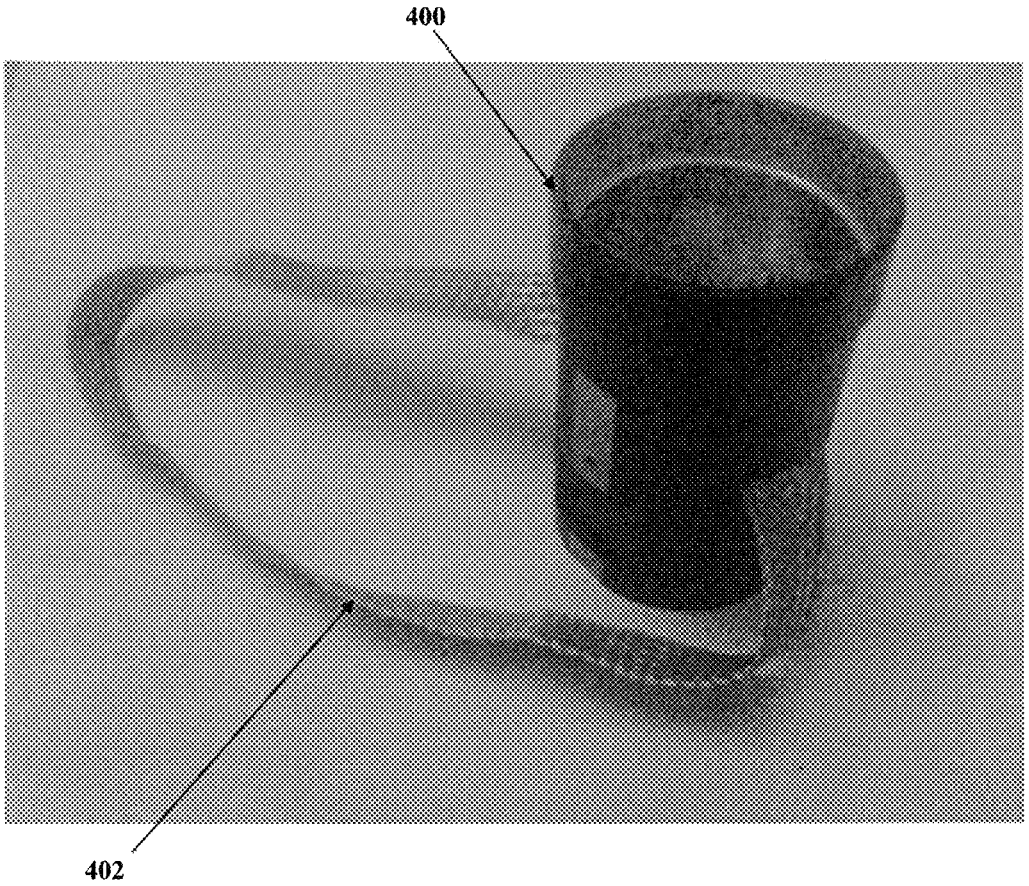

FIG. 4 is a perspective view of a light module housing with a flexible heat sink in accordance with an example embodiment of the invention.

DETAILED DESCRIPTION OF THE EXEMPLARY EMBODIMENTS

Embodiments of the invention are directed to the use of flexible heat sinks or multiple flexible heat sinks allowing for directional LED light sources that may be aimed on one or more axis while maintaining a sufficient path for heat to be sufficiently dissipated or removed from the fixture, thereby enabling the LED sources to be driven at a higher rate and a higher efficiency, long life, etc. to be achieved. The systems and methods described herein may also provide improved heat management solutions for recessed or partially or substantially enclosed light fixtures with LED sources.

Embodiments of the invention now will be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

FIG. 1 illustrates a cross sectional view of a light fixture 116 having two flexible heat sink elements 102 in accordance with one embodiment of the invention. As shown in the example embodiment of FIG. 1, the light fixture 116 includes a housing 106 having an aperture 114 surround by a housing trim element 108. The trim 108 forms the aperture 114 where light emitted by the LED light module 100 exits from the light fixture 116. The example LED light module 100 shown in FIG. 1 includes LED light sources 104 attached to a module housing 112 and aimed at a lens 110 to diffuse the light emitted by the LED light sources 104. In other embodiments of the invention, the lens 110 may be omitted from the light fixture 116. Additionally, the LED light sources 104 may be surrounded by reflective and/or refractive elements to control the light emitted by the LED light sources 104. The module housing 112 may be a circuit board or other substrate or may include a plate, bracket or stationary heat sink element with one end attached to a flexible heat sink 102. The flexible heat sink 102 shown in FIG. 1 may be a braided copper cable (or tube) that is tin plated and flattened, or other materials and configurations may be used to provide the flexible heat sink 102 such as mesh wire, wire cloth, other malleable metal or flexible ceramic materials.

As shown in the embodiment of FIG. 1, the flexible heat sinks 102 thermally connected the LED light module housing 112 (or the substrate of the LED light sources 104) to a portion of the fixture housing 118, which may be a rib, bracket, or member extending from the trim 108 or alternatively from a side wall of the housing 116, such that a thermal path is provided from the flexible heat sink 102 to the fixture housing 106 and, in the example embodiment of FIG. 1, to the trim 108 of housing. In the example embodiment of the invention shown in FIG. 1, once the thermally transferred heat reaches the outside of the light fixture housing 106 (or trim 108), the heat may be further dissipated, or the light fixture housing 106 (or trim 108) cooled by the ambient conditions outside of the light fixture 116. The flexible heat sinks may be connected to the fixture housing 106 or module housing 112 through a mechanical fastener (i.e., a screw, bolt, nail, rivet, or similar mechanical fastener means), through adhesion, or melted, welded, or braised to either housing.

FIG. 2 illustrates a cross sectional view of a light fixture 200 having a flexible heat sink 206 (e.g., braided cabling, malleable metal, or the like) in accordance with one embodiment of the invention. In FIG. 2, the flexible heat sink 206 contacts the bottom portion 208 of a circuit board of the LED light module 204 that contains one or more LED light sources. As shown in the example recessed fixture housing 202 configuration of FIG. 2, the flexible heat sink 206 may be configured such that it is positioned under and/or around the LED light module 204 and terminates near the top of the fixture housing 202 and/or outside surface of the fixture housing 202 (e.g., near the aperture, trim, and/or lens (or glass) cover of the fixture 200) to allow the heat transferred by the flexible heat sink 206 to be further dissipated outside the fixture housing 202. For directional LED light modules 204, as shown in FIG. 2, the flexible heat sink 206 should be long and flexible enough to be configured such that it will not interfere with the rotation of the LED light module 204 for direction aiming purposes. In another embodiment of the invention, multiple flexible heat sinks 206 may be used (e.g., one on each side of the LED light module 204). In yet another embodiment of the invention, the flexible heat sink may have both ends terminate at the LED light module 204.

FIG. 3 illustrates a cross sectional view of a light fixture 300 having a flexible heat sink in accordance with another embodiment of the invention. In contrast to the embodiment shown in FIG. 2, FIG. 3 shows an example embodiment of the invention where the flexible heat sink may be in contact with (and terminate) at the outer portion(s) 302 of the LED light module. In yet another embodiment of the invention (not shown), the flexible heat sink may be thermally coupled to the outside portion of the housing of the light fixture 300.

FIG. 4 is a perspective view of a light module housing 400 with a flexible heat sink 402 in accordance with an example embodiment of the invention. As shown in the example embodiment of FIG. 4, the flexible heat sink 402 is thermally coupled with the light module housing 400 at two sections along the side of the housing 400. In other embodiments of the invention the flexible heat sink 402 may be in contact with other portions of the module housing 400 (e.g., bottom, top, etc.). The flexible heat sink 402 shown in FIG. 4 is a braided copper cable (or tube) that is tin plated and flattened. In alternative embodiments of the invention, other materials and configurations may be used to provide the flexible heat sink 402 (e.g., mesh wire, wire cloth, other malleable metal or flexible ceramic materials, or the like). The light module shown in FIG. 4 may be incorporated into an in ground recessed light fixture; however, the flexible heat sink 402 may be used with other light fixtures as well, particularly light fixtures with directional light sources similar to that shown in FIG. 4 (e.g., LED light sources/modules that may be aimed, adjustable, and/or rotatable on one or more axes, etc.), recessed fixtures, or otherwise substantially sealed fixtures.

Accordingly, many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A light fixture comprising:

a light emitting diode (LED) light module, wherein the LED light module is adjustable on at least one axis;

at least one flexible heat sink member is thermally coupled with at least a portion of the LED light module, wherein the light fixture is recessed and the at least one flexible heat sink member terminates proximal to an opening of a light fixture housing, where the opening allows light emitted by the light module to exit the light fixture housing.

2. The light fixture of claim 1, wherein the at least one flexible heat sink member is braided.

3. The light fixture of claim 2, wherein the at least one flexible heat sink member is tin plated copper.

4. The light fixture of claim 1, wherein the at least one flexible heat sink member terminates proximal to a trim of the light fixture housing.

5. The light fixture of claim 1, wherein the at least one flexible heat sink member is thermally coupled with at least two portions of the LED light module.

6. The light fixture of claim 1, wherein the LED light module is rotatable on at least one axis.

7. The light fixture of claim 6, wherein the at least one flexible heat sink member is configured in the light fixture housing so as to not interfere with the rotation of the LED light module.

8. The light fixture of claim 1, wherein the at least one flexible heat sink member is thermally coupled with a circuit board of the LED light module, wherein the circuit board contains at least one LED.

9. The light fixture of claim 1, wherein the at least one flexible heat sink member is thermally coupled to the light fixture housing.

10. An apparatus comprising:

a light fixture housing forming a light emission aperture;

at least one LED attached to a circuit board that is surrounded by the light fixture housing and emits light through the light emission aperture when powered;

at least one flexible heat sink member that is thermally coupled with at least a portion of the circuit board and the light fixture housing, wherein the at least one flexible heat sink member is thermally coupled to the light fixture housing at a location proximal to the light emission aperture.

11. The apparatus of claim 10, wherein the at least one flexible heat sink is malleable.

12. The apparatus of claim 10, wherein the at least one flexible heat sink member is thermally coupled with at least two portions of the circuit board.

13. The apparatus of claim 10, wherein the at least one LED and circuit board are part of an LED light module, wherein the LED light module is rotatable on at least one axis.

14. The apparatus of claim 13, wherein the at least one flexible heat sink member is configured in the light fixture housing so as to not interfere with the rotation of the LED light module.

15. The apparatus of claim 10, wherein the at least one flexible heat sink member is braided.

16. The apparatus of claim 15, wherein the at least one flexible heat sink member is tin plated copper.

* * * * *